US010479549B2

(12) United States Patent
Kearns

(10) Patent No.: US 10,479,549 B2
(45) Date of Patent: Nov. 19, 2019

(54) CARTON WITH DISPENSER

(71) Applicant: Graphic Packaging International, Inc., Atlanta, GA (US)

(72) Inventor: Matthew R. Kearns, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/222,131

(22) Filed: Jul. 28, 2016

(65) Prior Publication Data

US 2017/0029162 A1 Feb. 2, 2017

Related U.S. Application Data

(60) Provisional application No. 62/282,429, filed on Jul. 31, 2015.

(51) Int. Cl.

| | |
|---|---|
| ***B65D 5/72*** | (2006.01) |
| ***B65D 5/54*** | (2006.01) |
| ***B65D 5/02*** | (2006.01) |
| ***B65D 5/42*** | (2006.01) |

(52) U.S. Cl.

CPC ..... *B65D 5/722* (2013.01); *B65D 5/542* (2013.01); *B65D 5/548* (2013.01)

(58) Field of Classification Search

CPC ..... B65D 5/722; B65D 5/542; B65D 5/548; B65D 5/744; B31B 3/26; B31B 3/60

USPC ..... 229/122, 117.31, 125.04, 122.1, 215, 229/125.08, 125.15, 221; 493/87; 221/305, 302; 53/133.4; 206/766

See application file for complete search history.

(56) References Cited

U.S. PATENT DOCUMENTS

| | | | |
|---|---|---|---|
| 2,886,232 | A | 5/1959 | Leone |
| 3,536,247 | A | 10/1970 | Gadiel |
| 5,458,272 | A | 10/1995 | Ward-Weber |
| 5,746,369 | A | 5/1998 | McDermott |

(Continued)

FOREIGN PATENT DOCUMENTS

| | | |
|---|---|---|
| EP | 0 295 503 B1 | 8/1991 |
| EP | 1 615 840 B1 | 11/2008 |

(Continued)

OTHER PUBLICATIONS

International Search Report and Written Opinion for PCT/US2016/044436 dated Nov. 4, 2016.

(Continued)

*Primary Examiner* — Christopher R Demeree

(74) *Attorney, Agent, or Firm* — Womble Bond Dickinson (US) LLP

(57) ABSTRACT

A carton for holding at least one article. The carton comprises a plurality of panels comprising a bottom panel, a front panel, a back panel, and a top panel and a plurality of end flaps for closing an end of the carton. A dispenser comprises a dispenser panel pivotably connected to at least one panel of the plurality of panels. The dispenser panel comprises a front portion comprising at least a portion of the front panel and as swing arm foldably connected to the front portion and comprising at least a portion of at least one end flap of the plurality of end flaps. The dispenser panel is moveable between a closed position and an open position allowing access to the interior of the carton. The dispenser comprises locking features for engaging the front panel and locking the dispenser panel in the open position.

36 Claims, 8 Drawing Sheets

(56) References Cited

U.S. PATENT DOCUMENTS

| | | | |
|---|---|---|---|
| 6,866,185 | B2 | 3/2005 | Harrelson |
| 7,000,803 | B2 | 2/2006 | Miller |
| 7,240,789 | B2 | 7/2007 | Sutherland |
| 7,331,509 | B2 | 2/2008 | Bates et al. |
| 7,648,048 | B2 | 1/2010 | Smith |
| 7,648,061 | B2 | 1/2010 | Zammit et al. |
| 7,712,653 | B2 | 5/2010 | DeBusk et al. |
| 7,757,934 | B2 | 7/2010 | Coltri-Johnson |
| 7,806,314 | B2 | 10/2010 | Sutherland |
| 7,815,097 | B2 | 10/2010 | Fogle et al. |
| 7,913,897 | B2 | 3/2011 | Manaige |
| 7,918,384 | B2 | 4/2011 | Gomes et al. |
| 7,992,765 | B2 | 8/2011 | Brand |
| 8,002,171 | B2 | 8/2011 | Ryan et al. |
| 8,087,570 | B2 | 1/2012 | Ho Fung |
| D675,514 | S | 2/2013 | Baker |
| 8,485,423 | B2 | 7/2013 | Thomas et al. |
| 8,646,654 | B2 | 2/2014 | Miller |
| 8,851,302 | B2 | 10/2014 | Burton et al. |
| 9,073,682 | B2 | 7/2015 | DeBusk et al. |
| 9,102,456 | B2 | 8/2015 | Thomas et al. |
| 9,394,093 | B2 | 7/2016 | Alexander et al. |
| 2003/0150759 | A1 | 8/2003 | White |
| 2006/0000880 | A1 | 1/2006 | Wein |
| 2015/0041363 | A1 | 2/2015 | Freeman |
| 2015/0041528 | A1 | 2/2015 | Merrill |

FOREIGN PATENT DOCUMENTS

| | | | |
|---|---|---|---|
| EP | 1 967 455 | B1 | 4/2010 |
| EP | 1 680 328 | B1 | 1/2011 |
| EP | 1 968 858 | B1 | 6/2011 |
| EP | 1 883 584 | B1 | 11/2012 |
| EP | 1 973 803 | B1 | 12/2012 |
| EP | 2 001 763 | B1 | 4/2013 |
| EP | 2 032 461 | B1 | 8/2014 |
| EP | 1 606 176 | B1 | 11/2015 |
| EP | 1 926 667 | B1 | 5/2016 |
| EP | 2 707 298 | B1 | 7/2016 |
| EP | 3 118 135 | A2 | 1/2017 |
| GB | 2 189 223 | A | 10/1987 |
| WO | WO 97/21607 | A1 | 6/1997 |
| WO | WO 2003/008277 | A2 | 1/2003 |
| WO | WO 2004/103826 | A2 | 12/2004 |
| WO | WO 2007/150014 | A2 | 12/2007 |
| WO | WO 2008/086272 | A1 | 7/2008 |
| WO | WO 2010/091229 | A2 | 8/2010 |
| WO | WO 2012/075372 | A2 | 6/2012 |
| WO | WO 2012/118595 | A1 | 9/2012 |
| WO | WO 2013/162942 | A1 | 10/2013 |

OTHER PUBLICATIONS

Supplementary European Search Report for EP 16 83 3566 dated Jan. 16, 2019.

CARTON WITH DISPENSER

CROSS REFERENCE TO RELATED APPLICATIONS

This application claims the benefit of U.S. Provisional Patent Application No. 62/282,429 filed Jul. 31, 2015.

INCORPORATION BY REFERENCE

The disclosure of U.S. Provisional Patent Application No. 62/282,429, which was filed Jul. 31, 2015, is hereby incorporated by references for all purposes as if presented herein in its entirety.

BACKGROUND OF THE DISCLOSURE

The present disclosure generally relates to cartons for holding articles such as food, non-food items or other types of articles. More specifically, the present disclosure relates to cartons having access and dispensing features.

SUMMARY OF THE DISCLOSURE

In general, one aspect of the disclosure is directed to a carton for holding at least one article. The carton comprises a plurality of panels that extends at least partially around an interior of the carton. The plurality of panels comprises a bottom panel, a front panel foldably connected to the bottom panel, a back panel foldably connected to the bottom panel, and a top panel foldably connected to at least one of the front panel and the back panel. A plurality of end flaps are each respectively foldably connected to a respective panel of the plurality of panels. The plurality of end flaps are for closing an end of the carton. A dispenser comprises a dispenser panel pivotably connected to at least one panel of the plurality of panels. The dispenser panel is at least partially defined by a dispenser tear line and comprises a front portion comprising at least a portion of the front panel and a swing arm foldably connected to the front portion and comprising at least a portion of at least one end flap of the plurality of end flaps. The dispenser panel is moveable between a closed position and an open position allowing access to the interior of the carton. The dispenser comprises locking features for engaging the front panel and locking the dispenser panel in the open position.

In another aspect, the disclosure is generally directed to a blank for forming a carton for holding at least one article. The blank comprises a plurality of panels comprising a bottom panel, a front panel foldably connected to the bottom panel, a back panel foldably connected to the bottom panel, and a top panel foldably connected to at least one of the front panel and the back panel. A plurality of end flaps are each respectively foldably connected to a respective panel of the plurality of panels. The plurality of end flaps are for closing an end of the carton formed from the blank. The blank comprises dispenser features for forming a dispenser comprising a dispenser panel that is pivotably connected to at least one panel of the plurality of panels. The dispenser panel is at least partially defined by a dispenser tear line and comprises a front portion comprising at least a portion of the front panel and a swing arm foldably connected to the front portion and comprising at least a portion of at least one end flap of the plurality of end flaps. The dispenser panel is moveable between a closed position and an open position allowing access to the interior of the carton formed from the blank. The dispenser features comprise locking features for engaging the front panel and locking the dispenser panel in the open position.

In another aspect, the disclosure is generally directed to a method of forming a carton. The method comprises obtaining a blank comprising a plurality of panels comprising a bottom panel, a front panel foldably connected to the bottom panel, a back panel foldably connected to the bottom panel, and a top panel foldably connected to at least one of the front panel and the back panel. The blank comprises a plurality of end flaps each respectively foldably connected to a respective panel of the plurality of panels. The blank comprises dispenser features for forming a dispenser comprising a dispenser panel that is pivotably connected to at least one panel of the plurality of panels. The dispenser panel is at least partially defined by a dispenser tear line and comprises a front portion comprising at least a portion of the front panel and a swing arm foldably connected to the front portion and comprising at least a portion of at least one end flap of the plurality of end flaps. The dispenser panel is moveable between a closed position and an open position allowing access to the interior of the carton. The dispenser comprises locking features for engaging the front panel and locking the dispenser panel in the open position. The method comprises forming an interior of the carton at least partially defined by the plurality of panels, and positioning the plurality of end flaps to at least partially close an end of the carton.

Those skilled in the art will appreciate the above stated advantages and other advantages and benefits of various additional embodiments from reading the following detailed description of the embodiments with reference to the below-listed figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Figure 1:
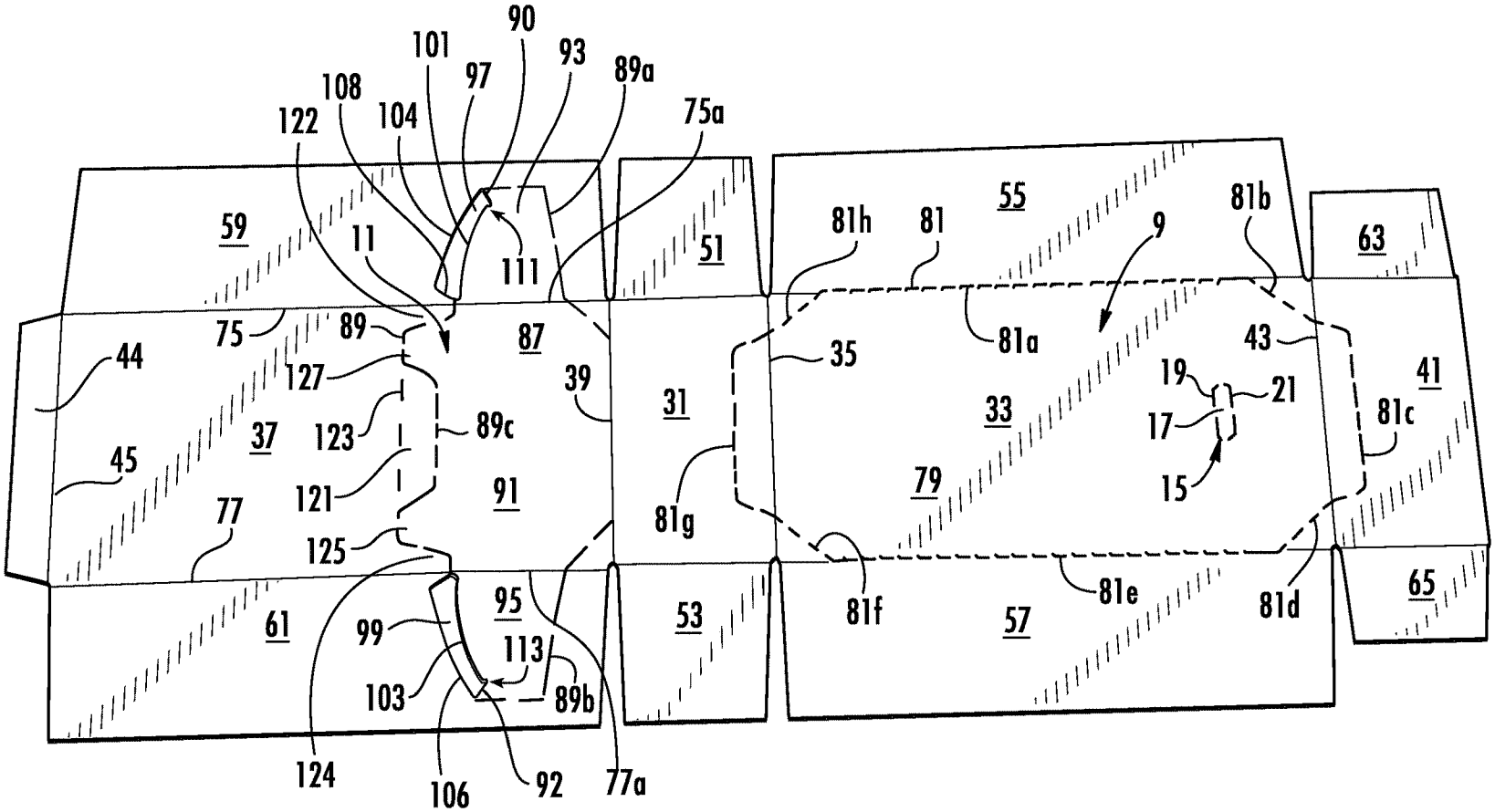
FIG. 1 is a plan view of a blank used to form a carton according to an embodiment of this disclosure.
Figure 2:
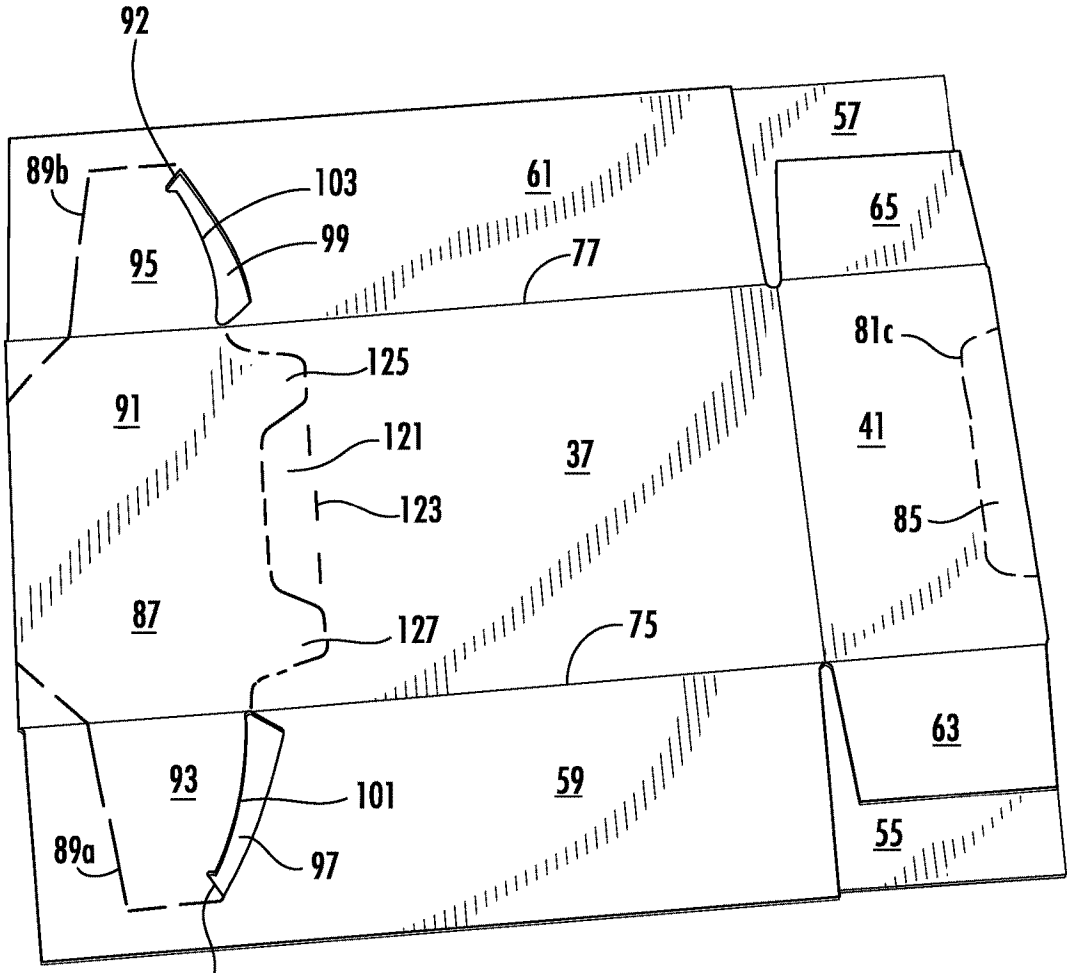
FIG. 2 is a perspective view of a blank used to form a carton according to an embodiment of this disclosure with the blank folded so the top panel overlaps the attachment flap.
Figure 3:
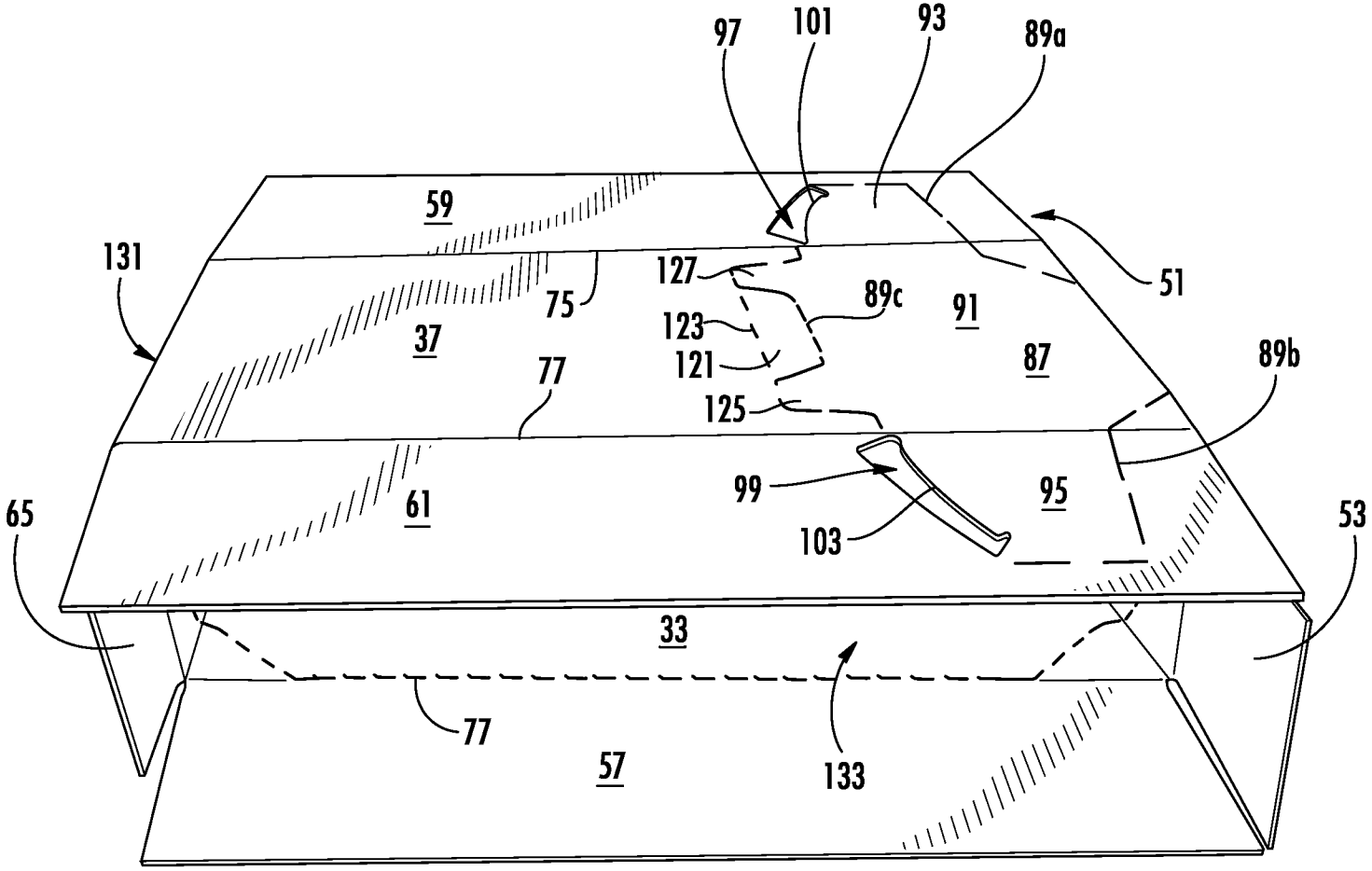
FIG. 3 is a perspective view of a blank used to form a carton according to an embodiment of this disclosure with the blank formed into an open-ended sleeve.
Figure 5A:
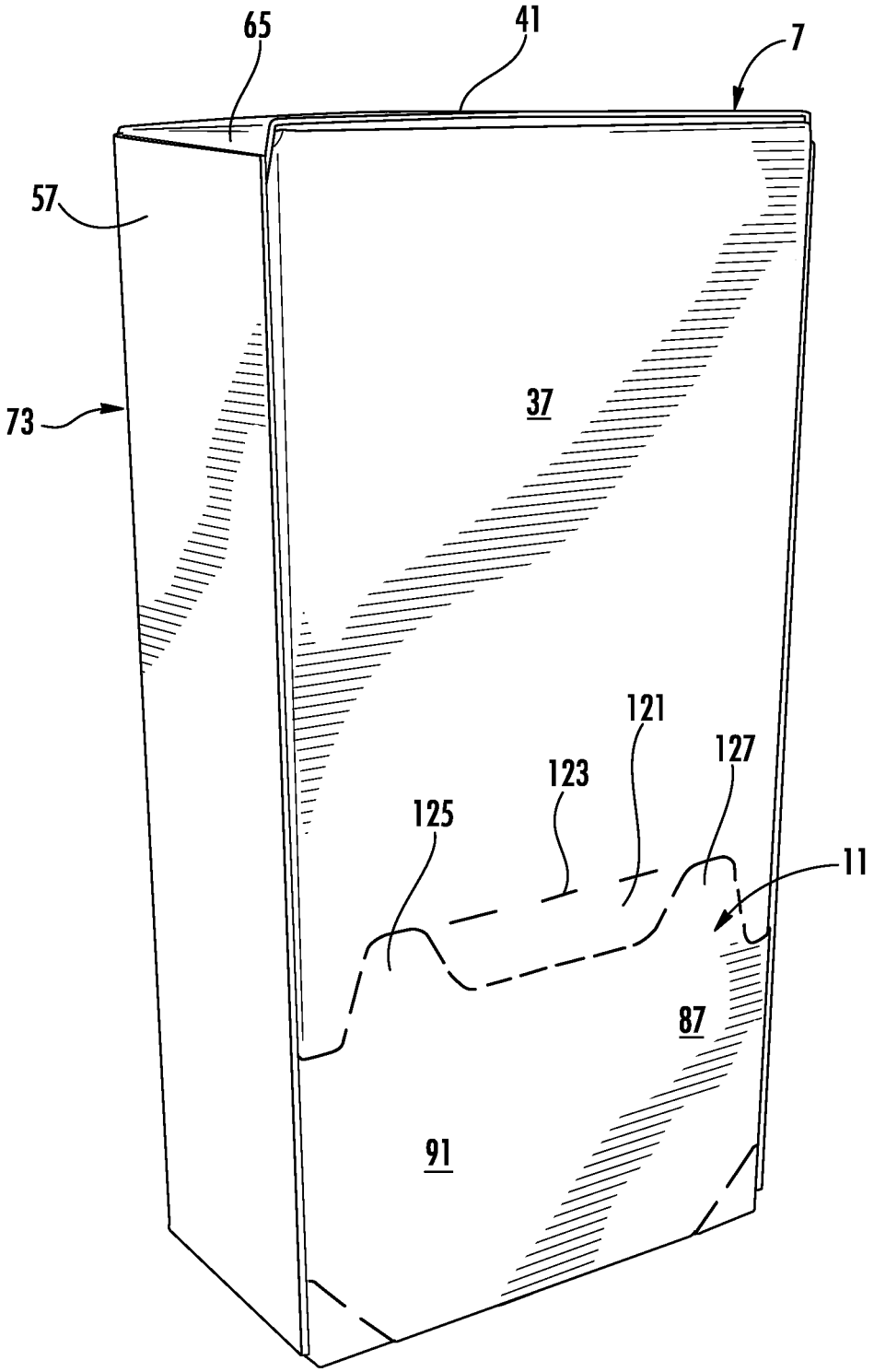
FIG. 5A is a perspective view of the carton formed from the blank according to an embodiment of this disclosure.
Figure 8A:
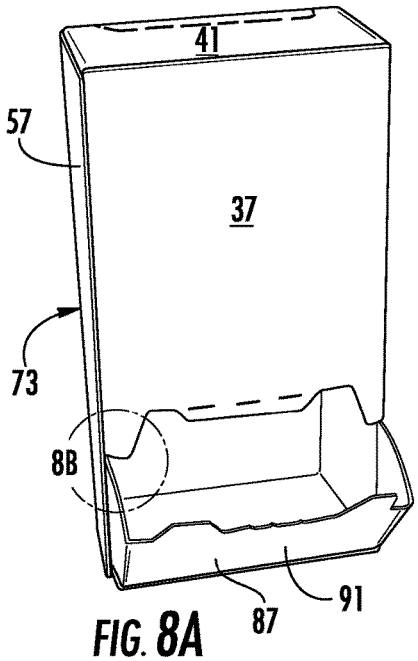
FIG. 8A is a perspective view of the carton formed from the blank with the second dispenser rotated to an open position according to an embodiment of this disclosure.
Figure 8B:
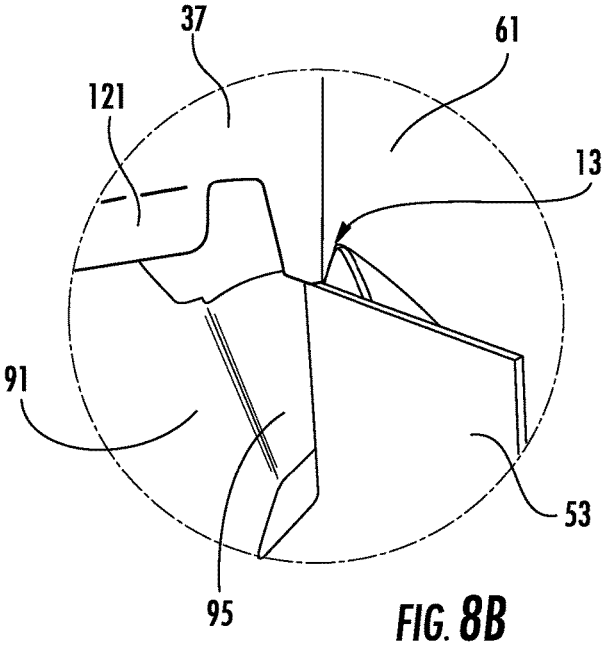
FIG. 8B is a close-up partial view of a corner of the second dispenser and a swing arm according to an embodiment of this disclosure.

FIG. 1 is a plan view of the exterior side 3 of a blank, generally indicated at 5, used to form a carton 7 (FIG. 5A) according to the exemplary embodiment of the disclosure. The carton 7 can be used to house a plurality of products such as prepackaged food items including candy, snack foods, animal treats, and small dispensable non-food items. In the illustrated embodiment, the carton 7 includes access features for forming and accessing a first (e.g., back) dispenser 9 and a second (e.g., front) dispenser 11. In one embodiment, the front dispenser 11 is hingedly connected to the carton and pivotable between a closed position (FIG. 5B) and an open position (FIG. 6). The front dispenser 11 has locking features 13 for holding the dispenser in the open position (FIGS. 6 and 8A-8B) and creating an audible locking sound when the front dispenser 11 is fully engaged (i.e., pivoted to the open position). As will be discussed below in more detail, the back and front dispensers 9, 11 and the locking features 13 are formed from various features in the blank 5.

The carton blank 5 has a longitudinal axis L1 and a lateral axis L2. In the embodiment of FIG. 1, the blank includes a bottom panel 31 foldably connected to a back panel 33 at a lateral fold line 35. A front panel 37 is foldably connected to the bottom panel 31 at a lateral fold line 39. A top panel 41 is foldably connected to the back panel 33 at a lateral fold line 43, and an attachment flap 44 is foldably connected to the front panel 37 at a lateral fold line 45. Any of the panels 31, 33, 37, 41 and the attachment flap 44 can be otherwise shaped, arranged, configured, or omitted, without departing from the disclosure. For example, the top panel 41 can be foldably connected to the front panel 37 or the attachment flap 44 can be foldably connected to the back panel 33 without departing from the disclosure.

The bottom panel 31 is foldably connected to a first end flap 51 and a second end flap 53. The back panel 33 is foldably connected to a first end flap 55 and a second flap 57. The front panel 37 is foldably connected to a first end flap 59 and a second end flap 61. The top panel 41 is foldably connected to a first end flap 63 and a second end flap 65. In one embodiment, when the carton 7 is erected, the end flaps 51, 55, 59, 63 close the first end 71 of the carton, and the end flaps 53, 57, 61, 65 close the second end 73 of the carton. In accordance with an alternative embodiment of the present disclosure, different flap arrangements can be used for closing the ends 71, 73 of the carton 7. Only the second end 73 of the carton 7 is shown in FIGS. 5A and 6, but it is understood that the first end 71 of the carton is closed in a substantially similar manner. In accordance with an alternative embodiment of the present disclosure, different flap arrangements can be used for closing the first end 71 and the second end 73 of the carton 7.

The end flaps 51, 55, 59, 63 extend along a first marginal area of the blank 5, and are foldably connected at a first longitudinal fold line 75 that extends along the length of the blank. The end flaps 53, 57, 61, 65 extend along a second marginal area of the carton blank 7, and are foldably connected at a second longitudinal fold line 77 that also extends along the length of the blank. The longitudinal fold lines 75, 77 may be, for example, substantially straight, curved, or offset at one or more locations to account for blank thickness or for other factors. The ends 71, 73 of the carton 7 could be otherwise shaped, arranged, and/or configured (e.g., at least partially tapered) without departing from the disclosure.

In one embodiment, the back panel 33 includes a hanging feature 15 having a flap 17 defined by a cut line 21 and the flap is foldably connected to back panel 33 along a lateral fold line 19. The hanging feature 15 may be activated by inwardly pushing the flap 17 creating an opening (not shown) for receiving a hook or similar mounting device for hanging or affixing the carton 7 in a chosen location.

In one embodiment, the carton 7 comprises a back dispenser 9 having a back dispenser panel 79 that comprises a portion of the back panel 33 and is removably attached to the carton 7 at a tear line, generally indicated at 81. The tear line 81 comprises two longitudinal portions 81*a*, 81*e* collinear with at least a portion of respective longitudinal fold lines 75, 77 and oblique potions 81*b*, 81*d*, 81*f*, 81*h* extending from the edges of the longitudinal portions 81*a*, 81*e*. The tear line 81 comprises lateral portions 81*g*, 81*c* extending in the bottom and top panels 31, 41 and connecting the oblique portions 81*f*, 81*h* and 81*b*, 81*d* respectively. At least a portion of the tear line 81 extends in the bottom panel 31, back panel 33, and top panel 41. The tear line 81 and back dispenser panel 79 could be otherwise shaped, arranged, and/or configured without departing from the disclosure. For instance, the tear line 81 could be curved without departing from the disclosure.

In the illustrated embodiment, the back dispenser panel 79 has a first access feature or flap 83 and a second access feature or flap 85 for accessing and removing the first dispenser panel 79 from the carton 7. The first access feature 83 is in the bottom panel 31 and defined by the lateral portion 81*g* and at least a portion of the oblique portions 81*f*, 81*h* of the fold line 81, and the lateral fold line 35. The second access feature 85 is in the top panel 41 and is at least partially defined by the lateral portion 81*c* and portions of the oblique portions 81*b*, 81*c* of the tear line 81. The back dispenser panel 79, including one or more access features 83, 85, could be otherwise shaped, arranged, configured, or omitted without departing from the disclosure.

As shown in FIG. 1, the front dispenser 11 includes a front dispenser panel 87 that is removably attached to the carton 7 at a tear line, generally indicated at 89. The front dispenser panel 87 is foldably connected to the bottom panel 31 at the lateral fold line 39. A portion of the lateral fold line 39 acts as a hinge to allow the front dispenser panel 87 to pivot relative to the bottom panel 31 and the front panel 37. The tear line 89 generally defines the second dispenser panel 87 and extends in the front panel 37 and the end flaps 59, 61. The tear line 89 also defines retention portions 122, 124 in the front panel 37 adjacent a respective fold line 75, 77.

In the illustrated embodiment, the front dispenser panel 87 includes a main panel 91 comprising a portion of the front panel 37, a first swing arm 93 comprising a portion of the end flap 59 and defined by a portion 89*a* of the tear line 89, and a second swing arm 95 comprising a portion of the end flap 61 and defined by a portion 89*b* of the tear line 89. In one embodiment, the first swing arm 93 is foldably connected to the main panel 91 along a portion 75*a* of the longitudinal fold line 75 and the second swing arm 95 is foldably connected to the main panel 91 along a portion 77*a* of the longitudinal fold line 77. The tear lines 89, 89*a*, 89*b* and fold line 39 could be otherwise shaped, arranged, and/or configured without departing from the disclosure. Additionally, the back dispenser 9 and the front dispenser 11 could be otherwise shaped, arranged, and/or configured without departing from the disclosure. The back dispenser 9 could be omitted without departing from the disclosure. Also, the "first" and "second" designation for the dispensers 9, 11 could be interchanged so that the front dispenser 11 is the "first" dispenser and the back dispenser 9 is the "second" dispenser without departing from the disclosure.

In one embodiment, the end flaps 59, 61 foldably connected to the front panel 37 each include a respective cut out or aperture 97, 99 adjacent a respective one of the first and second swing arms 93, 95. The swing arms 93, 95 include a generally curved upper edge 101, 103 defining an edge of the respective aperture 97, 99. In one embodiment, the apertures 97, 99 have a respective edge 104, 106 opposite a respective curved upper edge 101, 103 of a respective swing arm 93, 95.

As illustrated in FIG. 1, the apertures 97, 99 each have an end stop or rear wall 90, 92 extending between the diverging curved edges 101, 104 and 103, 106 at the farthest portion of the aperture away from the respective fold line 75, 77. The apertures 97, 99 each have a front wall 108, 110 extending between the generally diverging curved edges 101, 104 and 103, 106 at the closest portion of the aperture adjacent the respective fold line 75, 77. The aperture 97 is shaped so that the edges 101, 104 generally diverge as the edges extend toward the fold line 75 so the width (i.e., distance between the edges 101, 104) of the aperture 97 generally increases along the length of the aperture from the rear wall or end stop 90 to the front wall 108 of the aperture 97. Similarly, the aperture 99 is shaped so that the edges 103, 106 generally diverge as the edges extend towards the fold line 77 so that the width (i.e., the distance between the edges 103, 106) of the aperture 99 generally increases along the length of the aperture from the rear wall or end stop 92 to the front wall 110 of the aperture. The openings 97, 99 each have a first width between the curved edges 101, 104 and 103, 106 at the front wall 108, 110 that is greater than a second width between the curved edges at the stop wall 90, 92. The apertures 97, 99 could be otherwise shaped, arranged, and/or configured without departing from the disclosure.

In one embodiment, the apertures 97, 99 include a respective notch or relief catch area 111, 113 near the peripheral ends of the respective swing arm 93, 95. In the illustrated embodiment, the notches 111, 113 include indentations in the swing arms 93, 95 (as shown in at least FIGS. 1-3 and 7) that extend from a respective edge 101, 103 to a respective end stop 90, 92 so that when the front dispenser 11 is activated and pulled and rotated to the open position, retention portion 122, 124 of the front panel 37 engages the notch 111, 113 creating an audible "click" or locking sound. Also, at the fully open position of the front dispenser 11, the retention portions 122, 124 of the front panel 37 engage the respective notch 111, 113 and hold the dispenser panel 87 in the locked and open position. The engagement of the retention portions 122, 124 with a respective notch 111, 113 prevents the dispenser panel 87 from being easily removed from the carton 7 when the front dispenser 11 is pivoted to the open position. Further, the apertures 97, 99 are shaped to allow clearance for the stop edges 90, 92 of the swings arms 93, 95 so that the stop edges are free to move in the aperture towards a respective front wall 108, 110 of the aperture when the font dispenser 11 is pivoted to the open position.

In one embodiment, the access feature for opening the front dispenser 11 includes an access flap 121 in the front panel 37 defined by a tear line 89*c* and is foldably connected to the front panel 37 at a lateral fold line 123. The fold line 123 and the access flap 121 extend between the two upper portions 125, 127 of main panel 91 of the front dispenser panel 87. The shape of the access flap 121, and fold line 123 are not limited to the embodiment shown, for instance the access flap may have a semicircular shape, circular shape, angular shape, and free form symmetrical and asymmetrical shape without departing from the disclosure.

In one embodiment, the carton 7 can be formed from the blank 5 by folding the blank 5 along the lateral fold line 39 so that the front panel 37 overlaps at least a portion of the interior surface of the bottom panel 31 and the back panel 33 (FIG. 2), and folding the blank along the lateral fold line 43 so that the top panel 41 overlaps the back panel 33 and attachment flap 44. Alternatively, the blank 5 could be folded along the lateral fold lines 35, 45 so that the first top panel 41 overlaps the attachment flap 44. The top panel 41 can be glued to the attachment flap 44.

The blank then can be folded along fold lines 35, 39, 43, 45 to form an open-ended sleeve 131 (FIG. 3) with an interior 133. The product or articles can be loaded into the interior 133 of the open-ended sleeve 131 before or after closing either of the ends 71, 73. The blank 5 may be otherwise formed into the open-ended sleeve 131 using alternative folding and gluing steps without departing from the scope of this disclosure.

In the illustrated embodiment, the end flaps 51, 63 are inwardly folded along the longitudinal fold line 75 to at least partially close the first end 71. The end flap 59 is next folded and then the end flap 55 is folded along the longitudinal fold line 75, so that the end flap 59 with the swing arm 93 is positioned between the end flaps 51 and 55 (i.e., the exterior surface of the end flap 51 is in face-to-face contact with the interior surface of the end flap 59 and the exterior surface of the end flap 59 is in face-to-face contact with the interior surface of the end flap 55). When the front dispenser panel 89 is pivoted, the swing arm 93 can be in slidable contact with the end flaps 51, 55. In one embodiment, the top end flap 63 is glued in face-to-face contact with the side end flaps 55, 59. The bottom end flap 51 can be glued to a portion of the side end flaps 55, 59 with the swing arm 93 remaining free from adhesive attachment to both the bottom end flap 51 and the side end flap 59. The bottom end flap 51, the side end flaps 55, 59, and the top end flap 63 can be selectively adhered to one another to close the first end 71 of the carton 7.

In one embodiment, the second end 73 of the carton 7 can be closed in a similar manner as the first end 71 by folding, respectively overlapping, and selectively adhering the side end flaps 57, 61, the top end flap 65, and the bottom end flap 53. As with the first end 71, the second end 73 can be closed in a manner that results in the end flap 61 with the swing arm 95 positioned between the end flaps 53 and 57 (i.e., the exterior surface of the end flap 53 is in face-to-face contact with the interior surface of the end flap 61 and the exterior surface of the end flap 61 is in face-to-face contact with the interior surface of the end flap 57). The erected carton is shown in FIG. 5A. One or both of the ends 71, 73 could be otherwise shaped, arranged, configured, or omitted, without departing from the disclosure.

Figure 4:
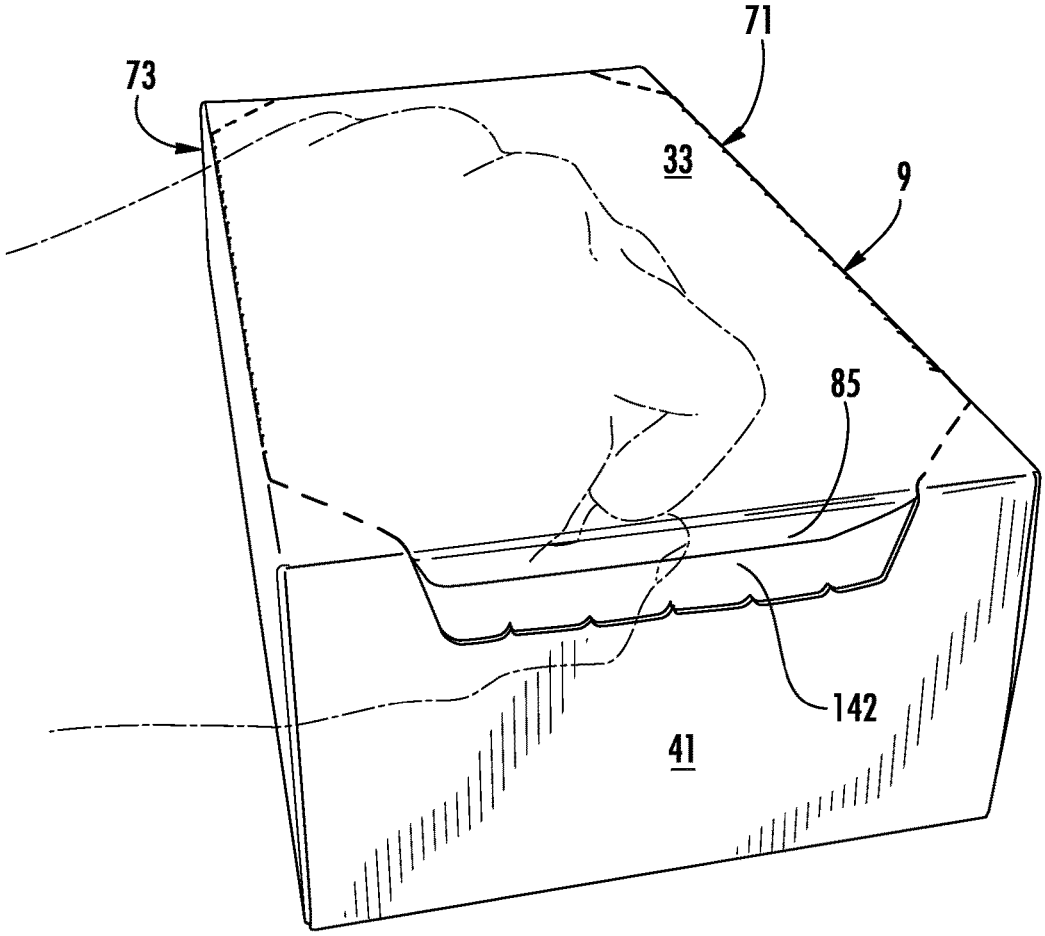
FIG. 4 is a perspective view of the carton formed from the blank with a first dispenser partially opened according to an embodiment of this disclosure.

In one embodiment, the back dispenser 9 can be opened by inwardly pushing the access flaps 83, 85 to separate the flaps at respective tear lines 81*c*, 81*g*, and forming openings 142 (FIG. 4). As the access flaps 83, 85 are activated they separate from a respective top and bottom panel 31, 41 along the tear lines and generally fold inward along fold lines 35, 43. The access flaps 83, 85 can be pulled outwardly to tear the back dispenser panel 79 along tear lines 81 to form a back dispenser opening. Products can be removed from the dispenser opening by a consumer. Alternatively, the back dispenser could be omitted from the carton 7 without departing from the disclosure.

Figure 5B:
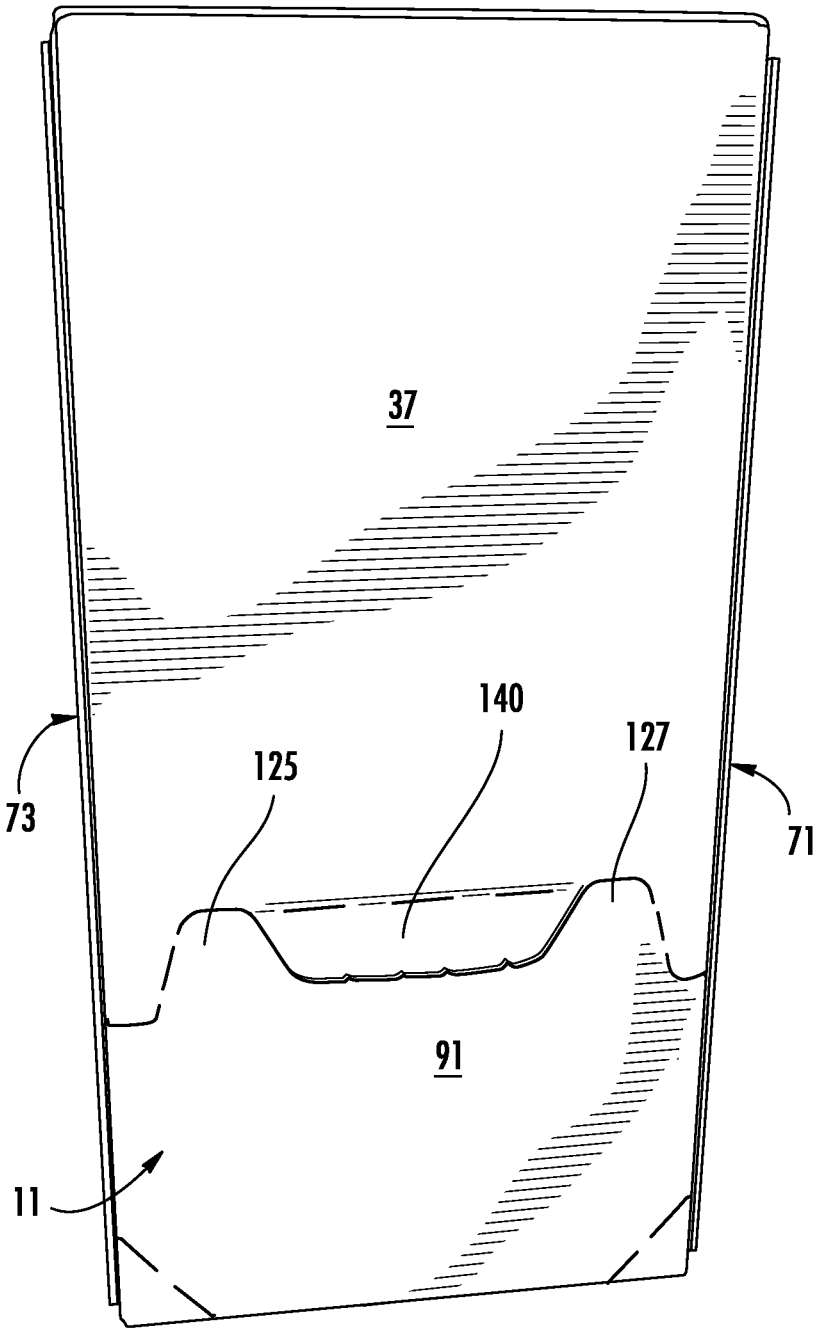
FIG. 5B is a perspective view of the carton formed from the blank with a second dispenser partially opened according to an embodiment of this disclosure.
Figure 6:
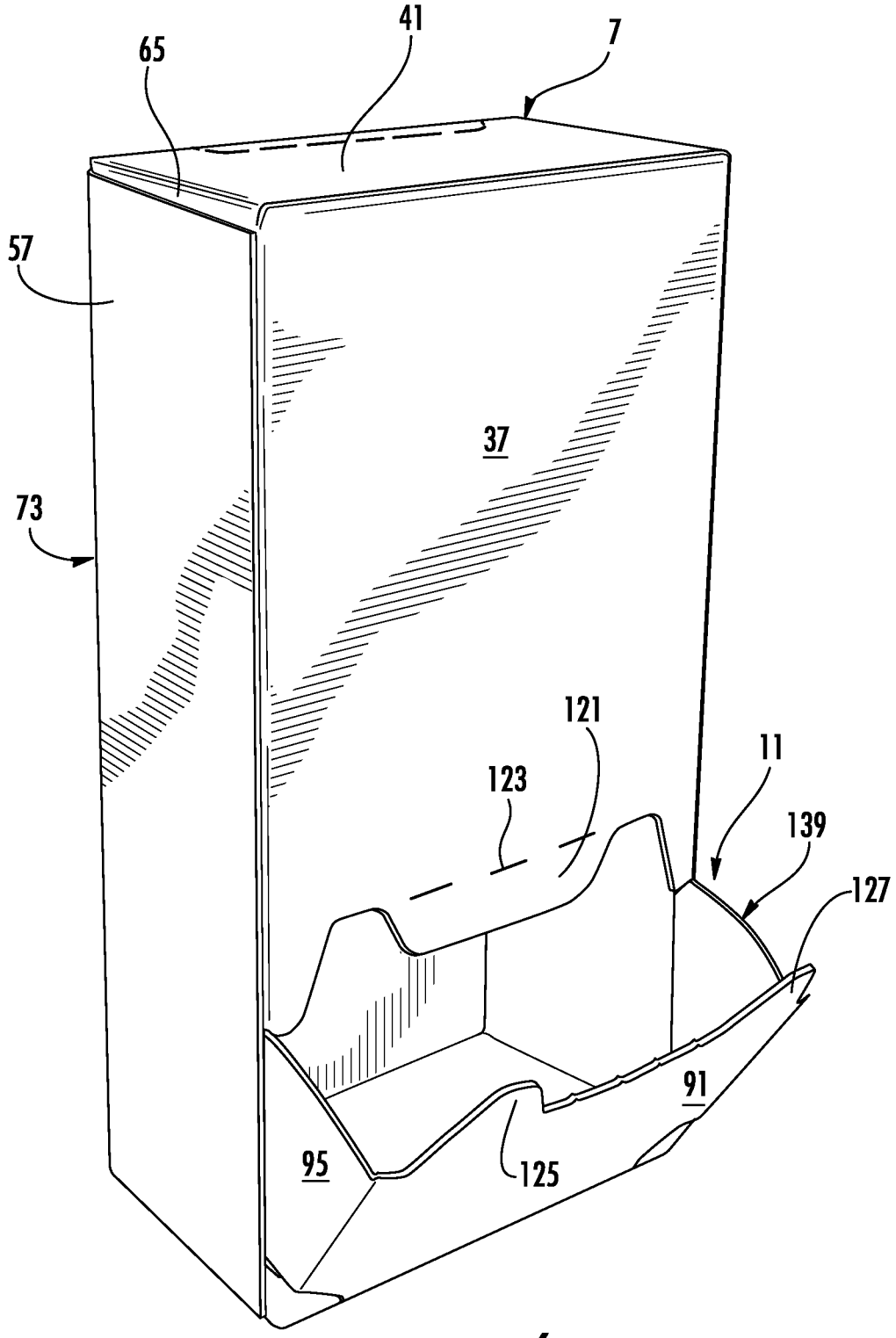
FIG. 6 is a perspective view of the carton formed from the blank with the second dispenser rotated to an open position according to an embodiment of this disclosure.
Figure 7:
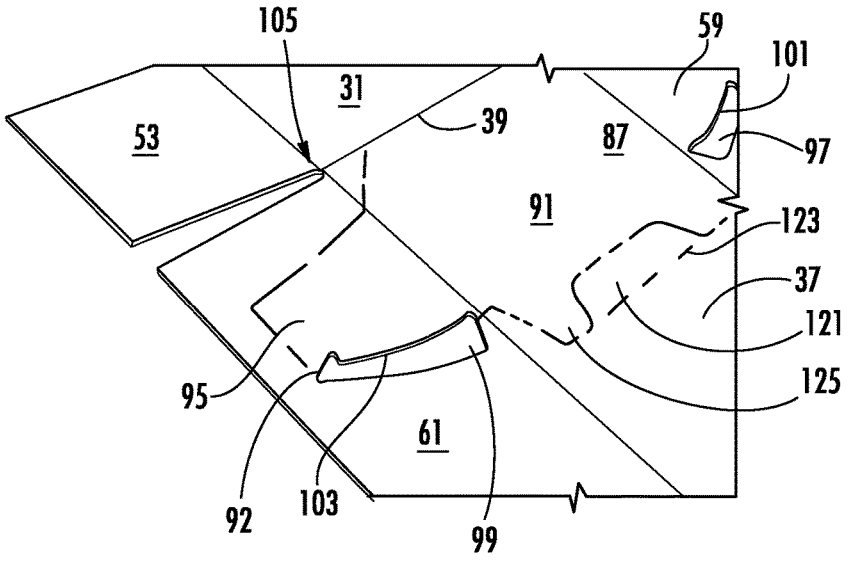
FIG. 7 is a close-up partial view of a swing arm of the blank according to an embodiment of this disclosure.

As illustrated in FIG. 6, the front dispenser 11 can be opened by inwardly pushing the access flap 121 to separate the flap at respective tear line 89*c*, and forming an opening 140 (FIG. 5B). As the access flap 121 is activated, the flap separates from the main panel 91 of the second dispenser 11 along the tear line 89*c* and generally folds inward along fold line 123. The top edge of the main panel 91 can be grasped and be pulled outwardly away from the front panel 37 to separate the dispenser panel 89 from the carton 7 by tearing along tear lines 89, 89*a*, 89*b*. As the front dispenser panel 89 is pulled outward and away from the front panel 37 a second dispenser opening 139 is formed in the carton 7 and the front dispenser panel 89, with main portion 91 and swing arms 93, 95 foldably connected to the main portion, pivots about fold line or hinge line 39. During the pivoting of the front dispenser panel 87 about the fold line from the closed position (FIG. 5B) to the open position (FIG. 6), the swing arm 93 pivots between the end flaps 51, 55 and the swing arm 95 pivots between the end flaps 53, 57. As the swing arms 93, 95 pivot, the stop edges 90, 92 are free to move in a respective opening 97, 99. The stop edges 90, 92 contact the retention portions 122, 124 of the front panel 37 and the retention portions are received in a respective notch 111, 113 in the fully opened position of the front dispenser 11. When the front dispenser 11 is rotated to the open position (FIG. 6), an audible "click" or locking sound is initiated by the engagement of the retention portions 122, 124 of the front panel in the notches 111, 113. At the open position, products can be removed from the dispenser opening 139 by a consumer.

Any of the features of the various embodiments of the disclosure can be combined with, replaced by, or otherwise configured with other features of other embodiments of the disclosure without departing from the scope of this disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels that extends at least partially around an interior of the carton, the plurality of panels comprising a bottom panel, a front panel foldably connected to the bottom panel, a back panel foldably connected to the bottom panel, and a top panel foldably connected to at least one of the front panel and the back panel;

a plurality of end flaps each respectively foldably connected to a respective panel of the plurality of panels, the plurality of end flaps being for closing an end of the carton;

a dispenser comprising a dispenser panel that is pivotably connected to at least one panel of the plurality of panels, the dispenser panel being at least partially defined by a dispenser tear line and comprising a front portion comprising at least a portion of the front panel and a swing arm foldably connected to the front portion and comprising at least a portion of at least one end flap of the plurality of end flaps, the swing arm comprising an upper edge, the dispenser panel being moveable between a closed position and an open position allowing access to the interior of the carton;

the dispenser comprises locking features comprising a relief catch area defined in the swing arm for engaging the front panel and locking the dispenser panel in the open position, the locking features comprising an opening in the end flap adjacent the swing arm and a stop edge of the swing arm, the opening is defined by a first edge, a second edge, a front wall, and the stop edge of the swing arm, the first edge is the upper edge of the swing arm and extends from the relief catch area to the front wall, the second edge extends from the stop edge to the front wall, and the first edge and the second edge diverge so that the opening has a first width at the front wall that is greater than a second width at the stop edge in the closed position of the dispenser panel, the relief catch area comprising an indentation in the swing arm extending from the upper edge of the swing arm to the stop edge, the stop edge disposed in the opening in the closed position and the open position of the dispenser panel.

2. The carton of claim 1, wherein the locking features comprise a retention portion in the front panel, the relief catch area engaging the retention portion when the dispenser panel is in the open position.

3. The carton of claim 1, wherein the locking features comprise at least one retention portion in the front panel.

4. The carton of claim 3, wherein the at least one end flap is foldably connected to the front panel at a fold line, the retention portion is defined by the fold line and the dispenser tear line.

5. The carton of claim 1, wherein the at least one end flap is a first end flap foldably connected to the front panel, the plurality of end flaps comprises a second end flap foldably connected to the bottom panel and a third end flap foldably connected to the back panel.

6. The carton of claim 5, wherein at least a portion of the first end flap overlaps at least a portion of the second end flap and at least a portion of the third end flap overlaps at least a portion of the first end flap.

7. The carton of claim 6, wherein the swing arm is in slidable engagement with the second end flap and the third end flap.

8. The carton of claim 7, wherein the swing arm is in slidable contact with the second end flap and the third end flap when the dispenser panel is pivoted between the closed position and the open position.

9. The carton of claim 1, wherein the dispenser comprises a hinge that pivotably connects the dispenser panel to the at least one panel.

10. The carton of claim 9, wherein the front panel is foldably connected to the bottom panel at a fold line, and the hinge comprises at least a portion of the fold line.

11. The carton of claim 10, wherein the dispenser tear line comprises an access flap in the front panel, and the access flap is adjacent the front portion of the dispenser panel for accessing the dispenser panel.

12. The carton of claim 1, wherein the dispenser is a front dispenser and the dispenser panel is a front dispenser panel, and the carton further comprises a back dispenser comprising a back dispenser panel, the back dispenser panel comprising at least a portion of the back panel.

13. The carton of claim 1, wherein the plurality of end flaps is a first plurality of end flaps, the end is a first end, and the at least one end flap is a first end flap of the first plurality of end flaps, the carton further comprises a second plurality of end flaps each respectively foldably connected to a respective panel of the plurality of panels for closing a second end of the carton, the swing arm is a first swing arm, the dispenser panel comprises a second swing arm foldably connected to the front portion, the second swing arm comprises a portion of a second end flap of the second plurality of end flaps, and the first end flap and the second end flap are foldably connected to the front panel.

14. A blank for forming a carton for holding at least one article, the blank comprising:

a plurality of panels comprising a bottom panel, a front panel foldably connected to the bottom panel, a back panel foldably connected to the bottom panel, and a top panel foldably connected to at least one of the front panel and the back panel;

a plurality of end flaps each respectively foldably connected to a respective panel of the plurality of panels, the plurality of end flaps being for closing an end of the carton formed from the blank;

dispenser features for forming a dispenser comprising a dispenser panel that is pivotably connected to at least one panel of the plurality of panels, the dispenser panel being at least partially defined by a dispenser tear line and comprising a front portion comprising at least a portion of the front panel and a swing arm foldably connected to the front portion and comprising at least a portion of at least one end flap of the plurality of end flaps, the swing arm comprising an upper edge, the dispenser panel being moveable between a closed position and an open position allowing access to the interior of the carton in the carton formed from the blank;

the dispenser features comprising locking features comprising a relief catch area defined in the swing arm for engaging the front panel and locking the dispenser panel in the open position, the locking features comprising a stop edge of the swing arm, the relief catch area comprising an indentation in the swing arm extending from the upper edge of the swing arm to the stop edge;

wherein the locking features comprise an opening in the end flap adjacent the swing arm, the stop edge is disposed in the opening in the closed position and the open position of the dispenser panel, the opening is defined by a first edge, a second edge, a front wall, and the stop edge of the swing arm, the first edge is the upper edge of the swing arm and extends from the relief catch area to the front wall, the second edge extends from the stop edge to the front wall, and the first edge and the second edge diverge so that the opening has a first width at the front wall that is greater than a second width at the stop edge in the closed position of the dispenser panel.

15. The blank of claim 14, wherein the stop edge is for being disposed in the opening in the closed position and the open position of the dispenser panel.

16. The blank of claim 14, wherein the locking features comprise a retention portion in the front panel, and the relief catch area is for engaging the retention portion when the dispenser panel is in the open position of the carton formed from the blank.

17. The blank of claim 14, wherein the locking features comprise at least one retention portion in the front panel, and the at least one end flap is foldably connected to the front panel at a fold line, the retention portion is defined by the fold line and the dispenser tear line.

18. The blank of claim 14, wherein the at least one end flap is a first end flap foldably connected to the front panel, the plurality of end flaps comprises a second end flap foldably connected to the bottom panel and a third end flap foldably connected to the back panel.

19. The blank of claim 14, wherein the dispenser comprises a hinge that pivotably connects the dispenser panel to the at least one panel.

20. The blank of claim 19, wherein the front panel is foldably connected to the bottom panel at a fold line, and the hinge comprises at least a portion of the fold line.

21. The blank of claim 20, wherein the dispenser tear line comprises an access flap in the front panel, and the access flap is adjacent the front portion of the dispenser panel for accessing the dispenser panel in the carton formed from the blank.

22. The blank of claim 14, wherein the dispenser is a front dispenser and the dispenser panel is a front dispenser panel, and the carton further comprises a back dispenser comprising a back dispenser panel, the back dispenser panel comprising at least a portion of the back panel.

23. The blank of claim 14, wherein the plurality of end flaps is a first plurality of end flaps, the end is a first end, and the at least one end flap is a first end flap of the first plurality of end flaps, the carton further comprises a second plurality of end flaps respectively foldably connected to a respective panel of the plurality of panels for closing a second end of the carton formed from the blank, the swing arm is a first swing arm, the dispenser panel comprises a second swing arm foldably connected to the front portion, the second swing arm comprises a portion of a second end flap of the second plurality of end flaps, and the first end flap and the second end flap are foldably connected to the front panel.

24. The blank of claim 14, wherein the swing arm is coplanar with the at least one end flap in the closed position and the open position of the dispenser panel when the carton is formed from the blank.

25. A method of forming a carton, the method comprising:

obtaining a blank comprising a plurality of panels comprising a bottom panel, a front panel foldably connected to the bottom panel, a back panel foldably connected to the bottom panel, and a top panel foldably connected to at least one of the front panel and the back panel, a plurality of end flaps each respectively foldably connected to a respective panel of the plurality of panels, a dispenser comprising a dispenser panel that is pivotably connected to at least one panel of the plurality of panels, the dispenser panel being at least partially defined by a dispenser tear line and comprising a front portion comprising at least a portion of the front panel and a swing arm foldably connected to the front portion and comprising at least a portion of at least one end flap of the plurality of end flaps, the swing arm comprising an upper edge, the dispenser panel being moveable between a closed position and an open position allowing access to the interior of the carton, the dispenser comprising locking features comprising an opening in the end flap adjacent the swing arm and a relief catch area defined in the swing arm for engaging the front panel and locking the dispenser panel in the open position, the locking features comprising a stop edge of the swing arm, the opening is defined by a first edge, a second edge, a front wall, and the stop edge of the swing arm, the first edge is the upper edge of the swing arm and extends from the relief catch area to the front wall, the second edge extends from the stop edge to the front wall, and the first edge and the second edge diverge so that the opening has a first width at the front wall that is greater than a second width at the stop edge in the closed position of the dispenser panel, the relief catch area comprising an indentation in the swing arm extending from the upper edge of the swing arm to the stop edge, the stop edge is disposed in the opening in the closed position and the open position of the dispenser panel;

forming an interior of the carton at least partially defined by the plurality of panels; and positioning the plurality of end flaps to at least partially close an end of the carton.

26. The method of claim 25, wherein the locking features comprise a retention portion in the front panel, the relief catch area engaging the retention portion when the dispenser panel is in the open position.

27. The method of claim 25, wherein the locking features comprise at least one retention portion in the front panel.

28. The method of claim 27, wherein the at least one end flap is foldably connected to the front panel at a fold line, the retention portion is defined by the fold line and the dispenser tear line.

29. The method of claim 25, wherein the at least one end flap is a first end flap foldably connected to the front panel, the plurality of end flaps comprises a second end flap foldably connected to the bottom panel and a third end flap foldably connected to the back panel, the positioning the plurality of end flaps comprises positioning the first end flap to overlap at least a portion of the second end flap and positioning at least a portion of the third end flap to overlap at least a portion of the first end flap.

30. The method of claim 29, wherein the swing arm is in slidable engagement with the second end flap and the third end flap.

31. The method of claim 30, wherein the swing arm is in slidable contact with the second end flap and the third end flap when the dispenser panel is pivoted between the closed position and the open position.

32. The method of claim 25, wherein the dispenser comprises a hinge that pivotably connects the dispenser panel to the at least one panel, and the front panel is foldably connected to the bottom panel at a fold line, and the hinge comprises at least a portion of the fold line.

33. The method of claim 32, wherein the dispenser tear line comprises an access flap in the front panel, and the access flap is adjacent the front portion of the dispenser panel for accessing the dispenser panel.

34. The method of claim 25, wherein the dispenser is a front dispenser and the dispenser panel is a front dispenser panel, and the carton further comprises a back dispenser comprising a back dispenser panel, the back dispenser panel comprising at least a portion of the back panel.

35. The method of claim 25, wherein the plurality of end flaps is a first plurality of end flaps, the end is a first end, and the at least one end flap is a first end flap of the first plurality of end flaps, the carton further comprises a second plurality of end flaps each respectively foldably connected to a respective panel of the plurality of panels for closing a second end of the carton, the swing arm is a first swing arm, the dispenser panel comprises a second swing arm foldably connected to the front portion, the second swing arm comprises a portion of a second end flap of the second plurality of end flaps, the first end flap and the second end flap are foldably connected to the front panel, and the method further comprises positioning the second plurality of end flaps to at least partially close a second end of the carton.

36. The method of claim 25, wherein the swing arm is coplanar with the at least one end flap in the closed position and the open position of the dispenser panel.

* * * * *